United States Patent [19]

Chapin

[11] 4,234,054

[45] Nov. 18, 1980

[54] MULTI-DUCT MUFFLER

[76] Inventor: John S. Chapin, #19 360 Freeport Blvd., Sparks, Nev. 89431

[21] Appl. No.: 897,333

[22] Filed: Apr. 18, 1978

[51] Int. Cl.[3] ..... F01N 1/10

[52] U.S. Cl. ..... 181/252; 181/249; 181/272; 181/296

[58] Field of Search ..... 181/252, 247, 248, 256, 181/265, 227, 198, 249, 264, 296; 55/DIG. 30; 29/157 R; 138/149

[56] References Cited

U.S. PATENT DOCUMENTS

| | | | |
|---|---|---|---|
| 2,072,961 | 3/1937 | Nelson | 181/256 |
| 2,732,026 | 1/1956 | Folts | 55/DIG. 30 |
| 2,790,464 | 4/1957 | Stephens et al. | 138/149 |
| 2,906,317 | 9/1959 | Keyes | 138/149 |
| 2,998,860 | 9/1961 | Everett | 181/257 |
| 3,175,586 | 3/1965 | Tatsch | 181/256 |
| 4,104,426 | 8/1978 | Gonzalez et al. | 181/227 |
| 4,108,276 | 8/1978 | Hall et al. | 181/256 |
| 4,121,686 | 10/1978 | Keller, Jr. | 181/252 |

OTHER PUBLICATIONS

Burgess Battery Company, "Flexibility of Design", May 21, 1932, p. 37.

*Primary Examiner*—L. T. Hix
*Assistant Examiner*—Benjamin R. Fuller
*Attorney, Agent, or Firm*—Herbert C. Schulze

[57] ABSTRACT

This invention is a new and improved muffler for use on the exhaust of noise producing machines such as automotive engines, and the like. It is particularly characterized by utilization of a single inlet into a chamber from which there are a multiplicity of louvered or otherwise appropriately configured exhaust tubes appropriately wrapped with noise entrapping material, and in a preferred form utilizing a ceramic fiber material, and wherein the multiplicity of tubes ultimately open into a chamber from which the ultimate outlet is ducted.

8 Claims, 7 Drawing Figures

MULTI-DUCT MUFFLER

CROSS REFERENCE TO RELATED APPLICATIONS

There are no related patent applications filed by me.

BACKGROUND OF THE INVENTION

1. Field of the Invention

This invention is in the general field of noise mufflers, and is more particularly directed to a muffler which is suitable to use in any noise making exhaust engine or mechanism including, but not limited to, internal combustion engines, diesel engines, air compressors, vacuum systems, and the like.

The muffler of this invention is more particularly directed to a muffler including a casing within which there are a pair of end chambers with a multiplicity of perforated tubes extending between the two chambers and in which the said tubes are covered by an entrapping material such that the exhaust may filter into the entrapping material and thence out again into the atmosphere or other disposition area.

It is even more particularly directed to such a muffler wherein there are at least two tubes covered by entrapping material within a single casing.

2. Description of the Prior Art

Many different mufflers are known to those skilled in the automotive arts and in other arts. In general, a muffler will consist of an enlarged casing attached to the exhaust of an engine, or the like, wherein within the casing there is a suitable baffling arrangement by which the noises are reduced to an acceptable level.

In recent years, there has been increasing attention to a form of muffler known as "glass packed" or "glass wrapped".

These mufflers utilize a muffler tube within a casing which tube has perforations, the most preferable type being called louvered, punched or sawed. The purpose of these various openings in the walls of the muffler tube is to divert the exhaust air and gases outward from the tube into a packing of theoretically noise absorbant material, such as fiberglass or the like, about the tube and within a casing. Ultimately, the exhaust returns through openings in the exhaust tube and exits into the atmosphere at its termination.

While the glass packed or glass wrapped exhaust tube of this nature is known, it has, until the present invention, been much less than thoroughly satisfactory since the exhaust has a great tendency to travel a direct path through the exhaust tube and the theoretical advantages of the glass are not achieved.

The present invention is unique and not anticipated in the prior are in that it utilizes a preliminary dispersing chamber for the exhaust, together with at least two exhaust tubes through which the exhaust is effectively filtered for the removal of noise. In this sense there is no prior art.

SUMMARY OF THE INVENTION

The problem of *noise pollution* is receiving more and more attention at the present time. With the great increase in industrial machinery, automobiles, and the like, the level of noise in urban areas (and most other areas) has risen markedly to the point where there are now numerous regulations concerning the noise level output of various machines and mechanisms. Mufflers are utilized in many of such machines and the like to accomplish compliance with the requirements.

The mufflers previously known have been ineffective to a large extent for meeting rigid requirements, and recently there have been developments in the field of so-called glass packed or glass wrapped mufflers. In this case, the muffler tube, which has many perforations about its circumference and length, is placed within a casing having fiberglass or the like either wrapped or packed between the case and the tube. What is accomplished by this is to provide a large number of small air pockets within the muffler which can entrap, break up, and silence the exhaust.

Such mufflers have been found to be somewhat ineffective, however, in meeting the requirements of many high performance mechanisms including many automotive engines. Problems exist with the tendency of the main stream of exhaust under high pressure to dissipate directly out of the muffler and through the muffler tube without taking advantage of the airpockets within the glass, and, additionally, when fully packed and restricted in such way that the exhaust gases do filter appropriately, the result is a back pressure against the engine resulting in a great loss of efficiency.

I have engaged in a study and much experimentation in this field and have now developed a much superior muffler of the type known as "glass wrapped" or "glass packed" and, in addition, I have discovered a new use for ceramic fiber material, which material is more resistant to heat and becomes more effective in long-term use particularly with automotive engines.

What I have accomplished is to provide a casing having a chamber at both its inlet and its exit ends, with at least two perforated muffler tubes wrapped with appropriate glass fiber or ceramic fiber, or the like, extending between the two end chambers in such manner that the exhaust entering the casing must dissipate to a certain extent in the preliminary end chamber, after which it filters effectively through the plurality of tubes without having a pressure tendency to move directly through the tube. Further, when it exits in the final exit chamber, a further reduction in noise is effected so that the overall result is a great reduction in noise with little back pressure effect upon the engine.

It is an object of this invention to provide a muffler for noise making equipment wherein the exhaust is divided into at least two different conduits, each being surrounded by air entrapping cells.

Another object of this invention is to provide an apparatus as above mentioned wherein the exhaust is filtered by the cellular material and then reintroduced into the tubes for expulsion into a common dispersion chamber.

The foregoing and other objects and advantages will become apparent to those skilled in the art upon reading the description of a preferred embodiment, which follows, in conjunction with a review of the appended drawings.

DESCRIPTION OF A PREFERRED EMBODIMENT

Figure 1:
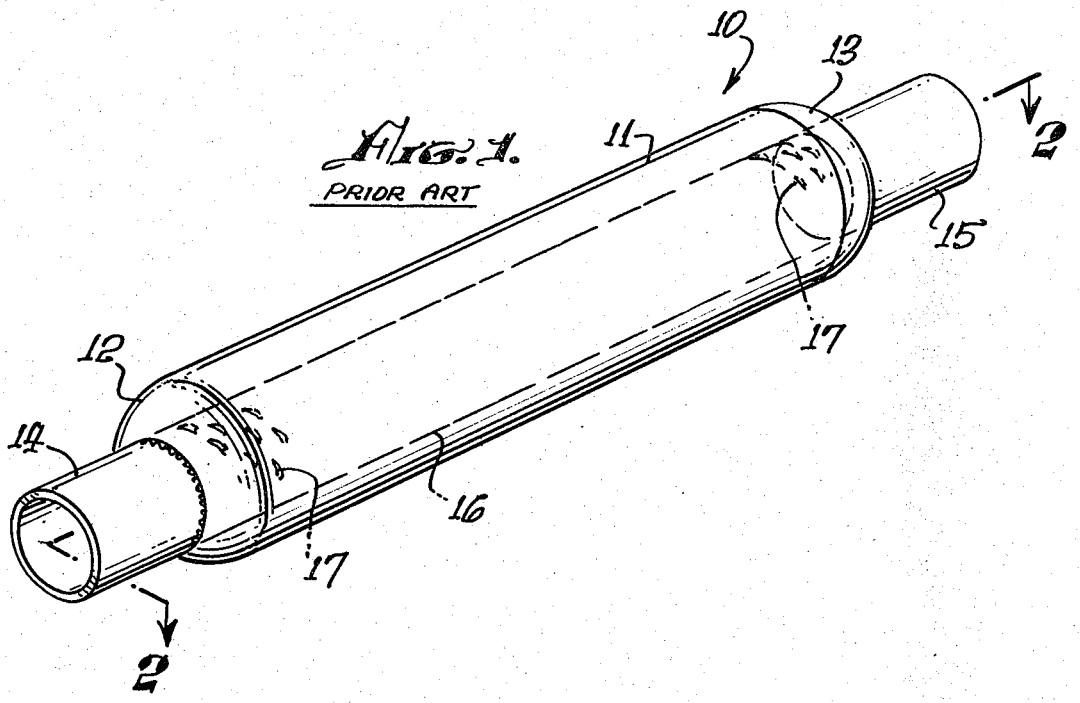
FIG. 1. PRIOR ART
FIG. 1 is a perspective of the prior art "glass wrapped" or "glass packed" mufflers.

The prior art in the so called "glass pack" or "glass wrap" muffler is shown in FIG. 1. The muffler generally 10 comprises a normally cylindrical casing 11 with dome or tapered ends 12 and 13 terminating in an inlet duct 14 and an outlet duct 15 respectively. Within the casing 11-12-13 there is a packing of fiberglass material 18 around a perforated tube 16. The perforations 17 are partially shown and their structure will be similar to that used in the preferred embodiment of this invention which will be described below. The purpose of the perforations 17 is to filter exhaust gases and the like into the glass packing 18 for the purpose of reducing noise. The inlet duct 14 is joined by means known in the art at 14*a* and the outlet duct 15 is joined by means also known in the art at 15*a*.

Figure 2:
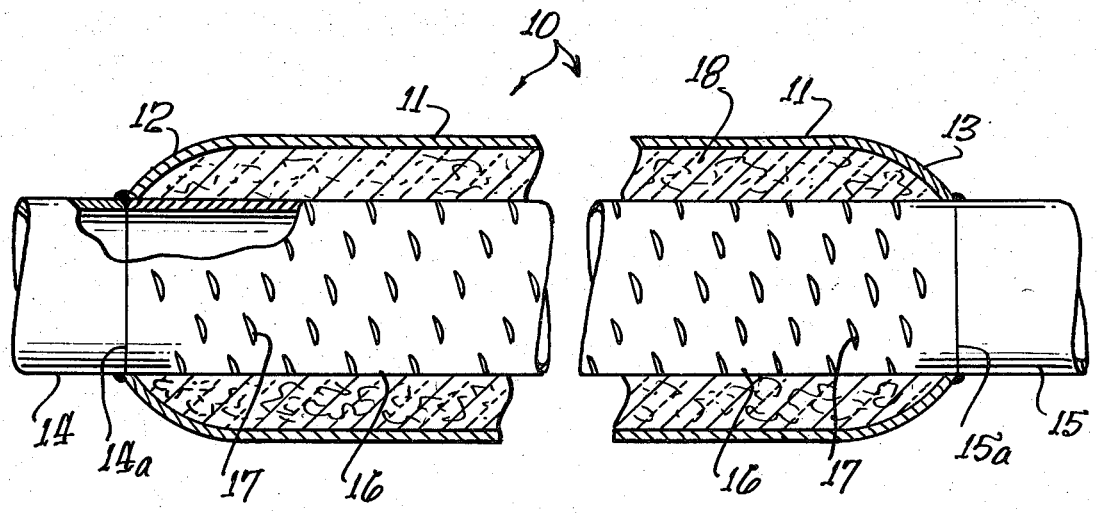
FIG. 2. PRIOR ART
FIG. 2 is a section on 2—2 of FIG. 1.

In operation of the prior art embodiment shown in FIGS. 1 and 2, the exhaust gases pass through the inlet duct 14 into the inner tube 16 from which a certain portion is filtered out into the glass pack 18 through the perforations 17. The exhaust gases themselves must in turn re-enter the tube 16 through other perforations 17 and will then exit through the outlet duct 15.

This type muffler as used in the prior art is generally superior to the so-called "backflow" muffler in certain respects. The backflow muffler is known to those skilled in the art and is much more subject to corrosion and backfire blowouts than the type shown in FIGS. 1 and 2. The type shown in FIGS. 1 and 2, however, have a great many deficiencies, the principal one of which is that there is much more noise generally from the glass pack as shown in FIGS. 1 and 2 and the backflow mufflers. This is generally true because of the tendency for much of the exhaust gas in this large center pipe to flow directly through without having the noise level reduced.

Figure 3:
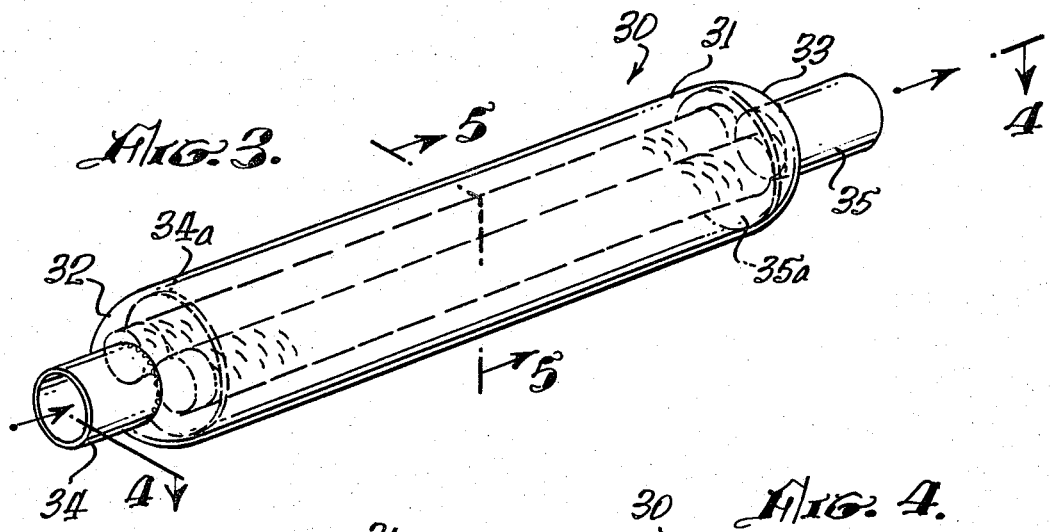
FIG. 3 is a perspective of a preferred embodiment of the muffler of this invention with certain portions in phantom.

Turning attention to FIGS. 3 through 7, there is illustrated a preferred embodiment of my invention. In FIG. 3, the muffler of this invention generally 30 is shown to consist of an outer casing 31 having dome like or tapered ends 32 and 33 much like the outer casing of the prior art. Likewise an inlet tube 34 and an outlet tube 35 are affixed to the ends 32 and 33 respectively in a relatively customary manner. What has been described so far of the embodiment of FIGS. 3 through 7 is where the similarity between the old art and this new invention ends, however.

The first element of difference may be found by examining the round plate 34*a* at the inlet end of the chamber and the similar plate 35*a* at the outlet end of the chamber. Each of these plates is solidly affixed to the casing 31 at its inner wall. Each of these plates has two openings into which tubes 36 and 46 are welded, or otherwise affixed in such manner that there is not leakage around them.

Each of the two tubes 36 and 46 has a series of perforations 37 and 47 which perforations are all of a relatively uniform nature. In the muffler art the formation of these perforations will be well known. The particular type I have used and illustrated in this embodiment are the so called "louvered" perforations. They take the appearance of somewhat of a quarter moon in each case and generally speaking are placed about the circumference of the tubes by a machine made for that purpose. The openings are cut in such a manner that at their rounded edge the metal is protruding downwardly into the interior of the tube. Thus, as the gases pass through the tubes they are caught, tumbled, and assisted in moving outward into the glass wrapping by this configuration. Other forms such as punched perforations and the like also leave metal protruding into the interior of the tubes for the same purpose of interrupting the flow.

Each of the tubes 36 and 46 is wrapped with a mat of fiberous material such as glass fiber or the like. The use of glass fiber in the prior art as illustrated in FIGS. 1 and 2 is known. I have added a new alternative, however, where I have now utilized ceramic fiber mats.

Ceramic fiber mats are known in many industrial and other uses. However, they have never before been used in mufflers. I have made a study of the ceramic fiber material and have determined that it gives a much lengthier life than the glass fiber, particularly where mufflers have a tendency to become over heated. Where the glass will sometimes be destroyed by the heat, the ceramic fiber does not, and I have found that the ceramic fiber has the unusual quality of giving superior noise suppression characteristics. This is perhaps due to its greater resistance to heat and its ability to withstand the tendency to deteriorate which effects the noise suppressing qualities.

Figure 6:
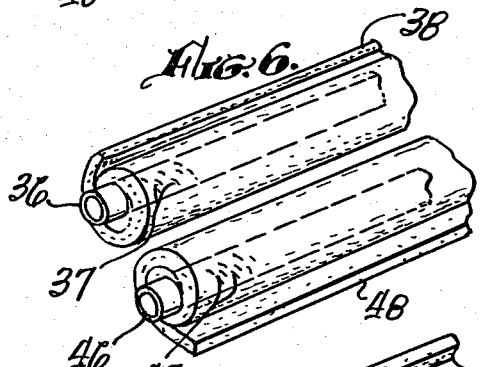
FIG. 6 is a partially broken away, reduced scale perspective showing the method of wrapping the inner tubes of the embodiment of FIGS. 4, 5, and 6.
Figure 7:
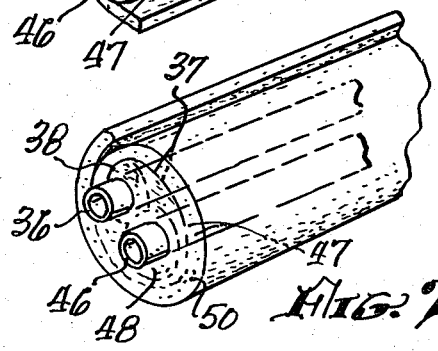
FIG. 7 is a partially broken perspective showing the method of overall wrapping of the two tubes shown in FIG. 6.

As is particularly shown in FIG. 6, a mat of the particular fiber to be used, whether it be ceramic fiber, glass fiber, or otherwise 38 is shown being wrapped about the tube 36, and a similar mat 48 being wrapped about the tube 46.

Figure 4:
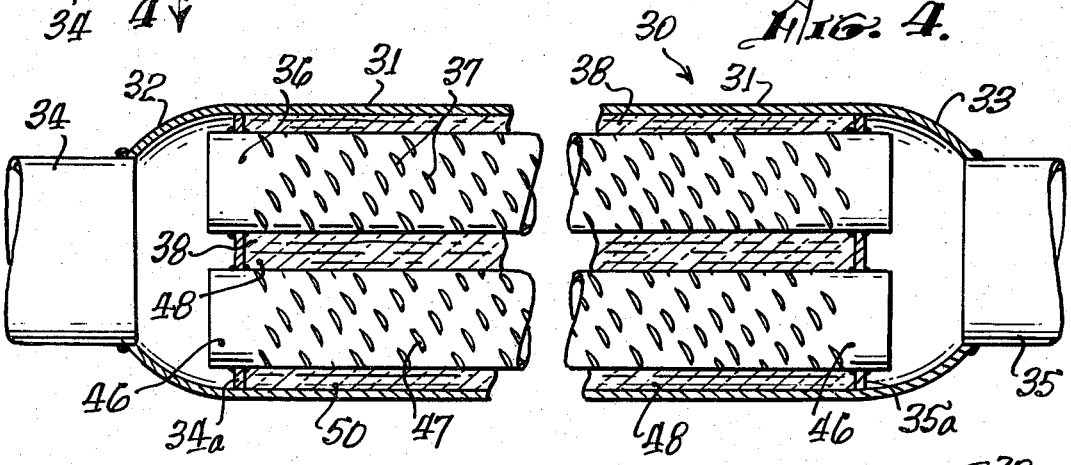
FIG. 4 is an enlarged section on 4—4 of FIG. 3.

Two tubes thus wrapped may be effectively utilized in an apparatus such as shown in FIGS. 3 and 4. However, I have found that by wrapping the two tubes 36 and 37 with the mats 38 and 48 so that their overall dimension is less than the interior of the casing 31 and then making a common wrapping around the two utilizing an additional layer of the wrapping material 50 that even more strange results are obtained and an unusually great noise suppressing quality is achieved. I do not know exactly why this particular method of wrapping is so superior, but it is, and this end result has been shown in FIG. 5.

Figure 5:
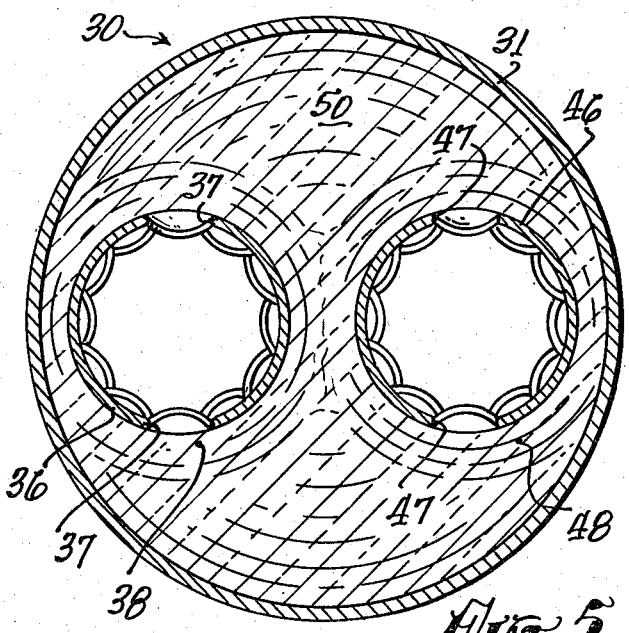
FIG. 5 is an enlarged section on 5—5 of FIG. 3.

In FIG. 5 I recognize that the illustration seems to show a blending of the wrappings 38, 48, and 50. In fact this seems to occur even though the individual mats are wrapped individually. The fibers seem to have a tendency to intertwine after the final wrapping and it is perhaps this quality which results in the increased effectiveness of the device.

I have, of course, experimented with mufflers using more than two of the interior tubes. For example, three tubes makes a very effective muffler. However, from the standpoint of economy the two are deemed preferable and are quite adequate.

As will be understood by those skilled in the art two tubes of smaller diameter as shown in FIGS. 3 though 7 provide a much more effective surface area for interruption of the noise carrying gases by the louvers or other openings.

I do not fully understand why it is that this overall system works so effectively. However, it does work extremely effectively and the two end chambers combined with the dual muffler tubes and the peculiar form of wrapping seem to lead to a rather unexpected result of extremely high noise reduction with virtually no engine back pressure. It appears that the rapid escape and return of the gases through the two tubes is enhanced in some manner by the end chamber, the method of wrapping, and the smaller diameter tubes.

While the embodiment of this invention shown and described is fully capable of achieving the objects and advantages desired it is to be understood that this embodiment has been shown for purposes of illustration only and not for purposes of limitation.

I claim:

1. A muffler for muffling noises of exhaust from a noise making machine including: (1) an elongated impervious casing having an inlet duct at one end and an outlet duct at the other end; (2) a first plate at a spaced distance from the inlet duct within said casing and fastened thereto around its inner circumference; (3) a second plate at a spaced distance from said outlet duct, and affixed to the interior of said casing about its circumference; (4) a first open-ended perforated tube extending through an opening in each of the first and second plates and intercommunicating between the space existing between each of said plates and their respective inlet and outlet ducts; (5) a second open-ended perforated tube extending through an opening in each of the first and second plates and intercommunicating between the space existing between each of said plates and their respective inlet and outlet ducts; and (6) a packing about said tubes and within said casing of a material having a multiplicity of air pockets.

2. The apparatus of claim 1 wherein the perforations are formed in such manner that metal extends from a portion of each perforation into the interior of each of said tubes.

3. The apparatus of claim 2 wherein the metal extending into the interior of said tubes extends into the interior of said tubes in the general direction of the outlet duct.

4. The apparatus of claim 2 wherein the packing about said tubes and within said casing comprises fiber mats wrapped around each of said tubes.

5. The apparatus of claim 4 wherein an additional mat of fiber is wrapped around both tubes which have previously been individually wrapped.

6. The method of wrapping exhaust ducting tubes comprising individually wrapping two exhaust ducting tubes with fiber mat; wrapping the two tubes so individually wrapped with a single fiber mat; and placing the entire package containing two tubes with their individual and collective wrapping within a casing.

7. The method of reducing exhaust noise from automotive vehicles comprising; (1) introducing the exhaust into a first chamber; (2) removing the exhaust from said first chamber through a plurality of open ended ducts; (3) removing a portion of said exhaust from said ducts and introducing the same into a second chamber, which second chamber contains a material forming a multiplicity of air pockets; (4) removing the exhaust from said second chamber and introducing it into a third chamber; and (5) removing the exhaust from said third chamber.

8. The method of claim 7 wherein the exhaust in said second chamber is re-introduced to the ducts in which it exited from the said first chamber and in which it then exits into the third chamber by means of said ducts.

* * * * *